United States Patent [19]

Diana

[11] Patent Number: 4,741,063

[45] Date of Patent: May 3, 1988

[54] SUSPENSION BRIDGE STRUCTURE WITH FLUTTER DAMPING MEANS

[75] Inventor: Giorgio Diana, Milan, Italy

[73] Assignee: Stretto di Messina, S.P.A., Rome, Italy

[21] Appl. No.: 9,896

[22] Filed: Feb. 2, 1987

[30] Foreign Application Priority Data

Feb. 5, 1986 [IT] Italy ..... 19302 A/86

[51] Int. Cl.[4] ..... E01D 11/00

[52] U.S. Cl. ..... 14/18; 14/17; 14/73

[58] Field of Search ..... 14/1, 17–20, 14/73; 52/84, 174; 244/123

[56] References Cited

U.S. PATENT DOCUMENTS

| | | | |
|---|---|---|---|
| 2,333,391 | 11/1943 | Robinson et al. | 14/18 |
| 2,380,183 | 7/1945 | Maney | 14/18 |
| 3,047,914 | 8/1962 | Kahn et al. | 52/84 X |
| 3,132,363 | 5/1964 | Roberts | 14/18 |
| 3,673,624 | 7/1972 | Finsterwalder et al. | 14/19 |
| 4,454,620 | 6/1984 | Barkdull, Jr. | 14/20 |

FOREIGN PATENT DOCUMENTS

| | | | |
|---|---|---|---|
| 277564 | 12/1951 | Switzerland | 14/1 |

OTHER PUBLICATIONS

Civil Engineering, "Wind Tunnel Tests Yield Aerodynamically Stable Bridge Sections", Dec. 1947, pp. 40–43.

*Primary Examiner*—Stephen J. Novosad
*Assistant Examiner*—John F. Letchford
*Attorney, Agent, or Firm*—Sixbey, Friedman & Leedom

[57] ABSTRACT

The invention concerns a suspension bridge comprising an essentially flat main structure, the upper surface of which forms the roadway for the transport means crossing the bridge, and a suspension structure formed of a plurality of catenary wires connected to end piers of the bridge and of a plurality of vertical stays for suspending the main flat bridge structure to the catenary wires. According to the invention, to the bridge structure there are associated wing control surfaces having an aerodynamic lifting and/or negative lifting action, the flutter speed proper to said wing control surfaces being considerably higher than the flutter speed proper to the bridge structure, and furthermore, the bridge structure and the wing control surfaces are stiffly interconnected and interact dynamically in order to shift the flutter speed of the whole at least above the top speed of the wind expected in the bridge area.

12 Claims, 6 Drawing Sheets

SUSPENSION BRIDGE STRUCTURE WITH FLUTTER DAMPING MEANS

BACKGROUND OF THE INVENTION

The present invention concerns suspension bridges comprising an essentially flat main structure, the upper surface of which forms the roadway for the transport means crossing the bridge, and a suspension structure, formed of a plurality of catenary wires connected to end piers of the bridge and of a plurality of vertical stays for suspending the main flat bridge structure to the catenary wires.

It is known the these suspension bridges have vibration frequencies of their own; normally, with no wind, the basic flexural vibration frequency differs from the basic torsional vibration frequency, both being generally very low. Nevertheless, the action of side winds varies said typical vibration frequencies, particularly because—especially in bridges with large transversal dimensions and/or a wide span, for instance motorway bridges—the flat suspended structure behaves, when actually exposed to side winds, similarly to a wing surface, hence with a "lifting" effect which greatly varies from one moment to the next.

As wind increases its strength, the two aforespecified vibration frequencies tend to approach, up to the point of coinciding: in these circumstances, the structure is thus subjected to so-called "flutter" conditions, i.e. to flexural-torsional deformations which may even result dangerous for the stability of the whole structure. The wind speed causing these phenomena is called "flutter speed".

These flutter phenomena, and the problems connected thereto, are already taken into consideration when planning suspension bridge: in fact, in calculating the structure, one tries to make sure that its flutter speed is very high, or anyhow considerably higher than that determined by the highest wind speeds registered in the bridge area, so that the risk of flutter phenomena is extremely low or almost none.

Various expedients have been proposed for this purpose. In particular, according to a fairly widespread technique, oblique or transversal windbracing stays are provided, which transversally stiffen the bridge structure and are therefore apt to resist to any flexural and/or torsional deformations thereof. This technique has obviously the drawback of making the bridge structure considerably heavier, and it is anyhow difficult to apply to very long bridges.

Another known technique consists in constructing the surfaces, along which run the transport means, in the form of so-called "transparent roadway", i.e. formed of gratings which, leaving a free passage of air in the vertical direction, greatly reduce the lifting effect of the bridge wing structure, consequently preventing any flutter phenomena. Even this technique has however some limitations as, though it can always be applied to roadways crossed by trains or by technical service means, it is nevertheless unthinkable for roadways used by private means.

SUMMARY OF THE INVENTION

The object of the present invention is to propose a suspension bridge structure, apt to prevent the aforementioned drawbacks of known structures and wherein, in particular, the flutter speed is very high. This result is obtained with a structure apt to dynamically resist to any flutter phenomena determined by the wind—and this the more powerfully, the worse the conditions of the wind generating said phenomona—essentially due to the fact that, to the bridge structure there are associated wing control surfaces, having an aerodynamic lifting and/or negative lifting action, the flutter speed proper to said wing control surfaces being considerably higher than the flutter speed proper to the bridge structure, and to the fact that the bridge structure and the wing control surfaces are stiffly interconnected and interact dynamically in order to shift the flutter speed of the whole at least above the top speed of the wind expected in the bridge area.

According to a preferred embodiment of the invention, the wing control surfaces have a symmetrical profile and are fixed just under the lateral edges of the flat main structures of the bridge with their plane of symmetry inclined in respect of the horizontal plane To each of the wing control surface there is associated another non-lifting aerodynamic control surface, for instance a grating, acting essentially so as to deviate the wind stream and being positioned laterally and above the surface of the bridge roadway.

According to another embodiment of the invention, the wing control surfaces have a symmetrical profile and are anchored to the bridge suspension structure at a height above the maximum height of the fixed structures associated to the roadway, as well as of the transport means crossing said roadway.

In this embodiment, the wing control surfaces are mounted on both of the two suspension structures fixed to the bridge sides, and are furthermore positioned with their plane of symmetry horizontal and with their leading edge facing towards the longitudinal central axis of the bridge itself.

According to a fundamental characteristic of the invention, all the wing control surfaces are stably and rigidly fixed to the bridge suspension structure, so as to form with the bridge a whole, apt to dynamically respond in a unitary manner to the stresses determined by the wind.

BRIEF DESCRIPTION OF THE DRAWINGS

Further characteristics and advantages of the structure according to the present invention will anyhow appear more evident from the following description of some preferred embodiments thereof, illustrated by way of example on the accompanying drawings, in which.

DESCRIPTION OF THE PREFERRED EMBODIMENT

Figure 1:
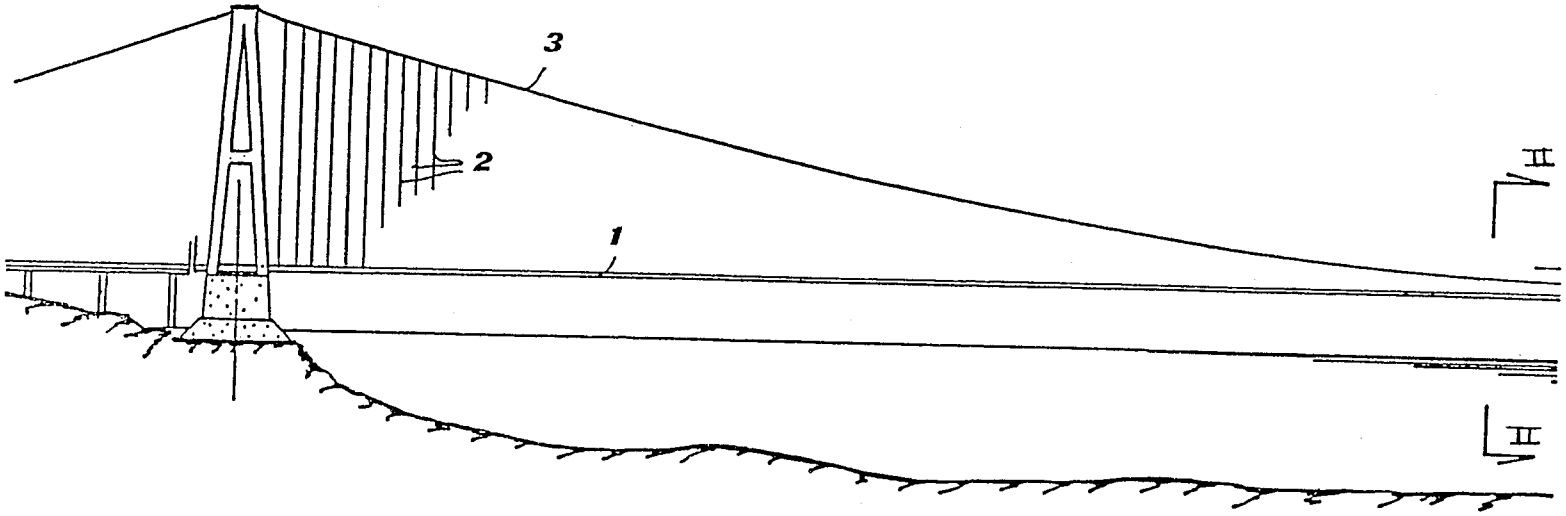
FIG. 1 is a comprehensive side view of one half of the suspension bridge.

The bridge structure illustrated in FIG. 1 substantially corresponds to that planned for crossing the Straits of Messina, which provides for two piers 400 m high, rising at a mutual distance of 3300 m, and for a bridge height of 80 m above sea level. On a bridge of such dimensions, positioned in an area which is notoriously hit by strong wind currents, the flutter phenomena represent one of the most serious and most difficult problems to solve.

Figure 2:
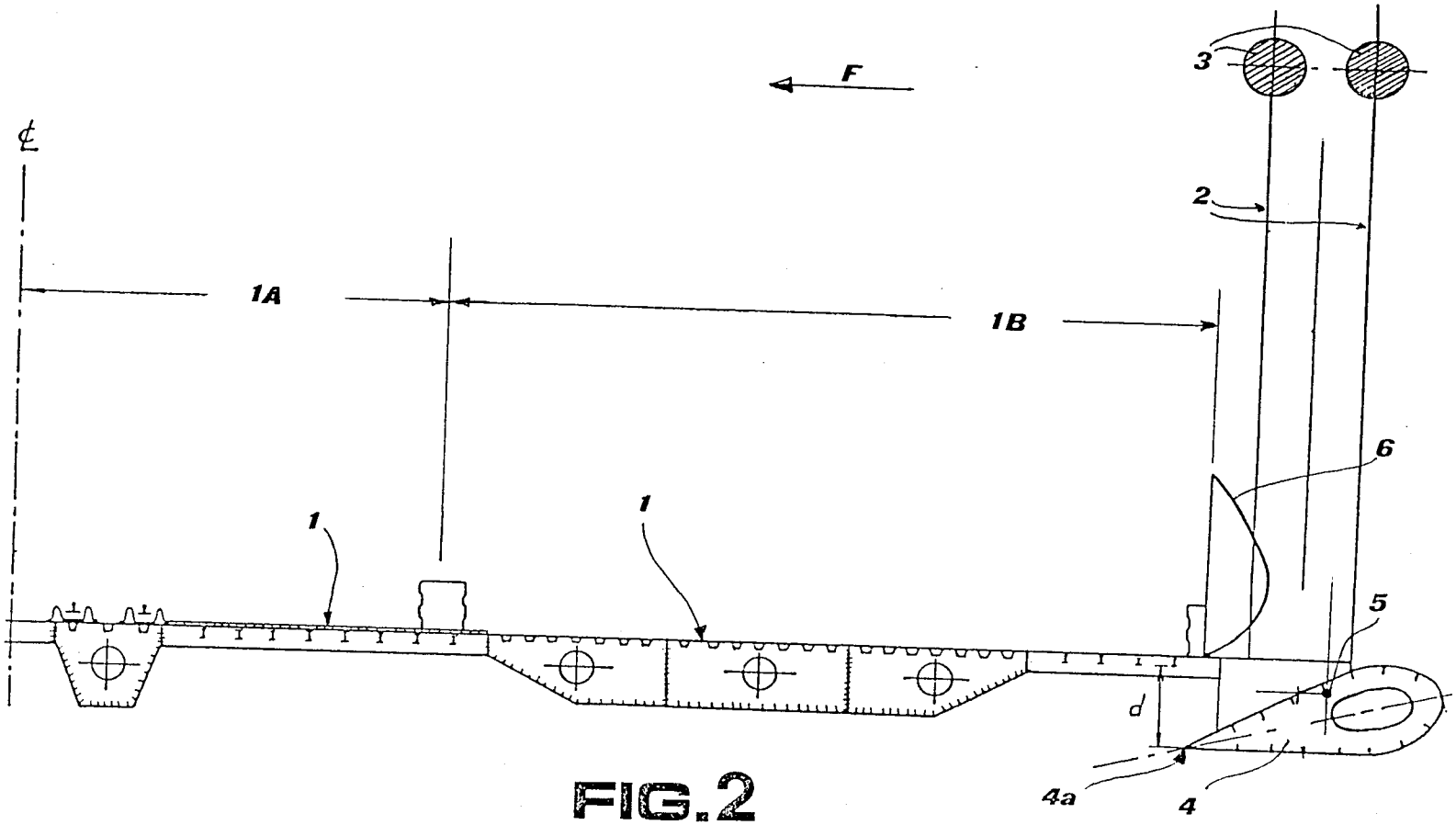
FIG. 2 is a diagrammatic cross section view of a first embodiment of the bridge, along the line II—II of FIG. 1.

FIG. 2 shows a cross section of a first embodiment of the bridge, comprising a roadway 1, with a central section 1A reserved for railways and service means, and two side sections 1B reserved for motorways. To the extreme sides of the roadway 1 there are anchored the vertical suspension stays 2, connected to catenary carrying cables 3, according to an arrangement substantially known per se.

In the preferred embodiment shown in FIG. 2, a wing control surface 4 is fixed in correspondence of the lower part of each of the two lateral edges of the roadway 1. Said wing surface has a symmetrical profile, its plane of symmetry being inclined in respect of the horizontal plane and its leading edge facing towards the outer part of the bridge.

Preferably, the inclination of the wing surface 4 is adjustable, by rotation about the hingeing axis 5, to allow a variation of the clear span d beween the trailing edge 4*a* of the wing surface 4 and the lower surface of the roadway 1.

To the wing surface 4 there is associated another non-lifting aerodynamic control surface 6, simply designed to deviate the wind stream. The surface 6 is preferably formed of a grating, having a parabolic shape with convexity facing towards the direction F of the wind. The top edge of the surface 6 is normally at a height above the uppermost level reached by the traffic crossing the bridge, so that the wind stream may be positively deviated above said traffic.

Practical tests carried out in a wind tunnel, on a dynamic model of the bridge according to the embodiment of FIG. 2, have allowed to ascertain first of all that the damping of induced oscillations—more precisely, the progres of torsional oscillations resulting from an initial disturbance—notably varies not only according to wind speed, but also according to the angle of inclination of the wing surface 4. By rotating said wing surface 4 in respect of its hingeing axis 5—i.e. by varying the clear span d—it has been possible to determine a position of improved behaviour of the structure. Tests carried out with a wind speed on the model of 14.9 m/sec (corresponding to a wind speed on the real bridge of about 150 Km/h) have allowed to ascertain—as shown on the graph of FIG. 4—that, as the angle of incidence of the wind (reported in ordinates) varies in respect of the surface of the roadway 1:

- the aerodynamic resistance of the bridge, indicated by $C_D$, remains substantially constant;
- the moment induced on the bridge, indicated by $C_M$, remains in turn substantially constant; and
- the lifting action, indicated by L, undergoes an increase as the angle of incidence of the wind increases, said increases keeping however within extremely contained limits;

all this proves a high stability of the bridge even in particularly strong wind conditions.

It should be pointed out that the above reported tests were carried out with at least partially transparent bridge roadways; in particular, a transparent roadway—i.e. formed of gratings—crossed the central section 1A of the bridge, reserved for railways and service means. For checking purposes, the tests were repeated after having filled said gratings: it was thus possible to confirm the high efficiency of the wing control surfaces according to the invention, even if the bridge provded to be slightly less stable in strong wind conditions.

Figure 4:
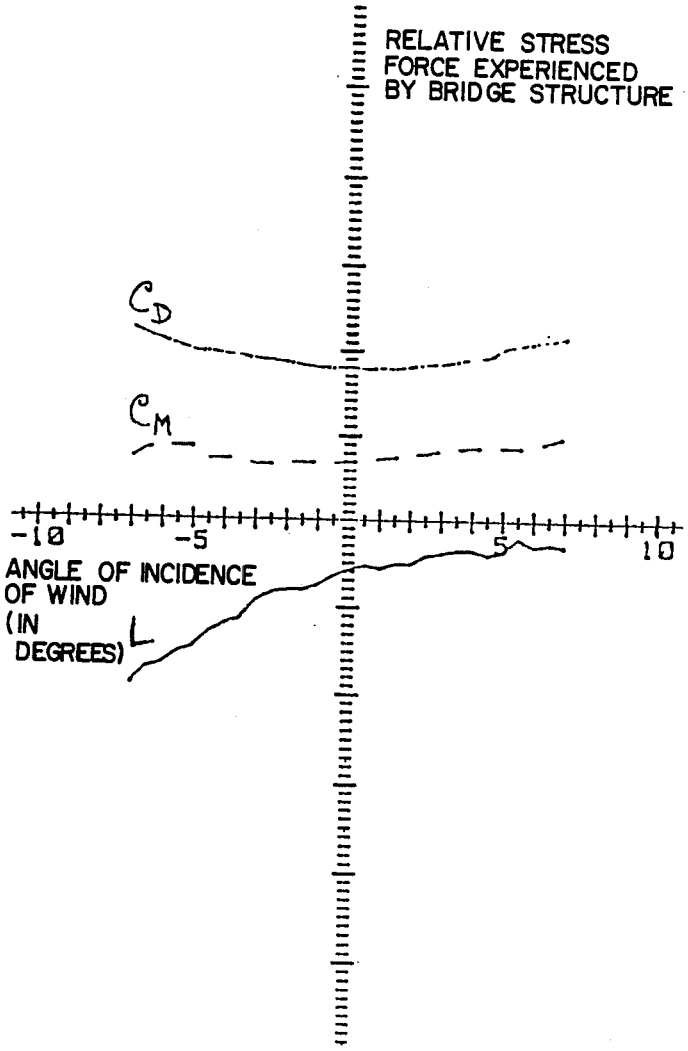
FIG. 4 is a diagram of the stresses to which a bridge of the type shown in FIG. 2 is subjected, in conditions of steady wind with variable angle of incidence.
Figure 5:
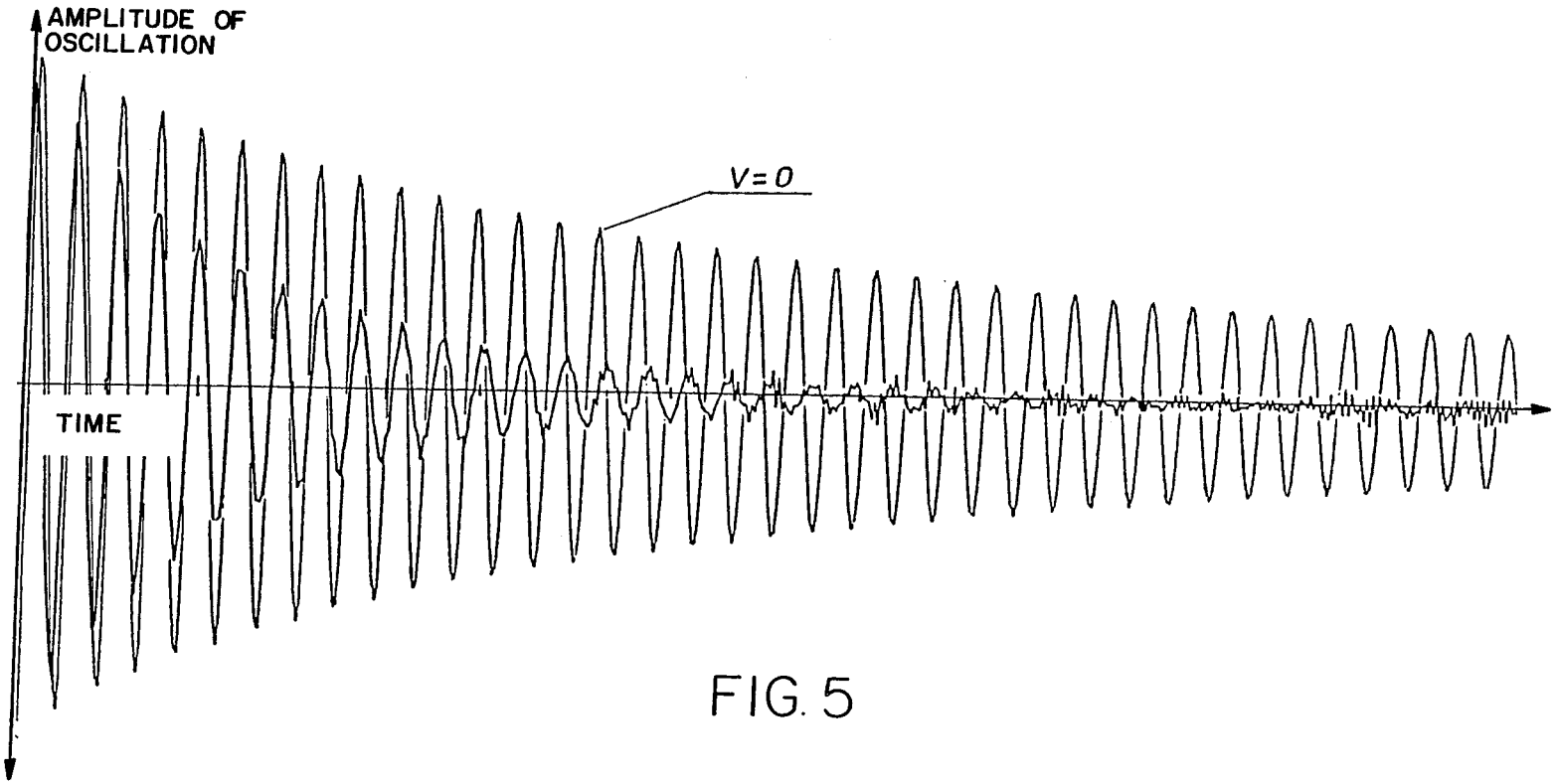
FIGS. 5 and 6 are two further graphs showing the damping of the bridge oscillations, following an initial disturbance, with wind blowing at about 140 Km/h and, respectively, 200 Km/h.
Figure 6:
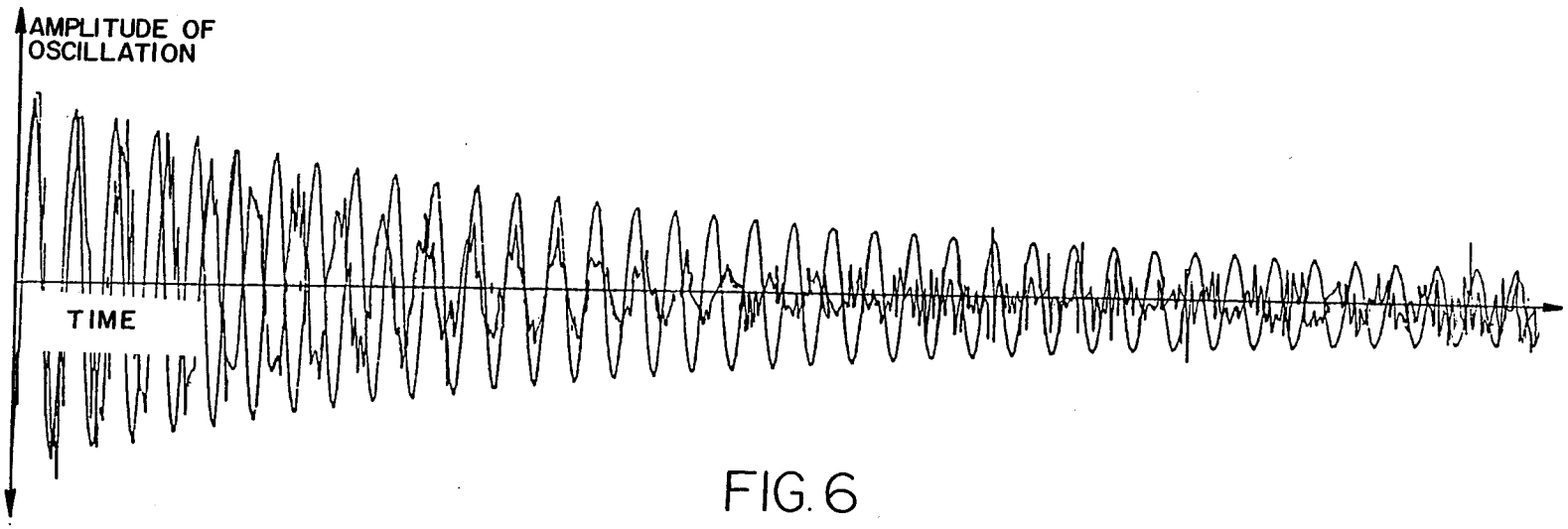

The graph of FIG. 5 shows that—with a wind speed on the model of 14.1 m/sec, i.e. about the same as that referred to in the graph of FIG. 4—the reduction of torsional oscillations, resulting from an initial disturbance, is fast and progressivie. A substantially equivalent behaviour is evidenced with even higher wind speeds, for example—as shown by the graph of FIG. 6—with a speed on the model of 20.12 m/sec (in reality, a speed exceeding 200 Km/h). This data obviously confirms the data evidence by the graph of FIG. 4, i.e. the high stability of the bridge even in very strong wind conditions.

Figure 3:
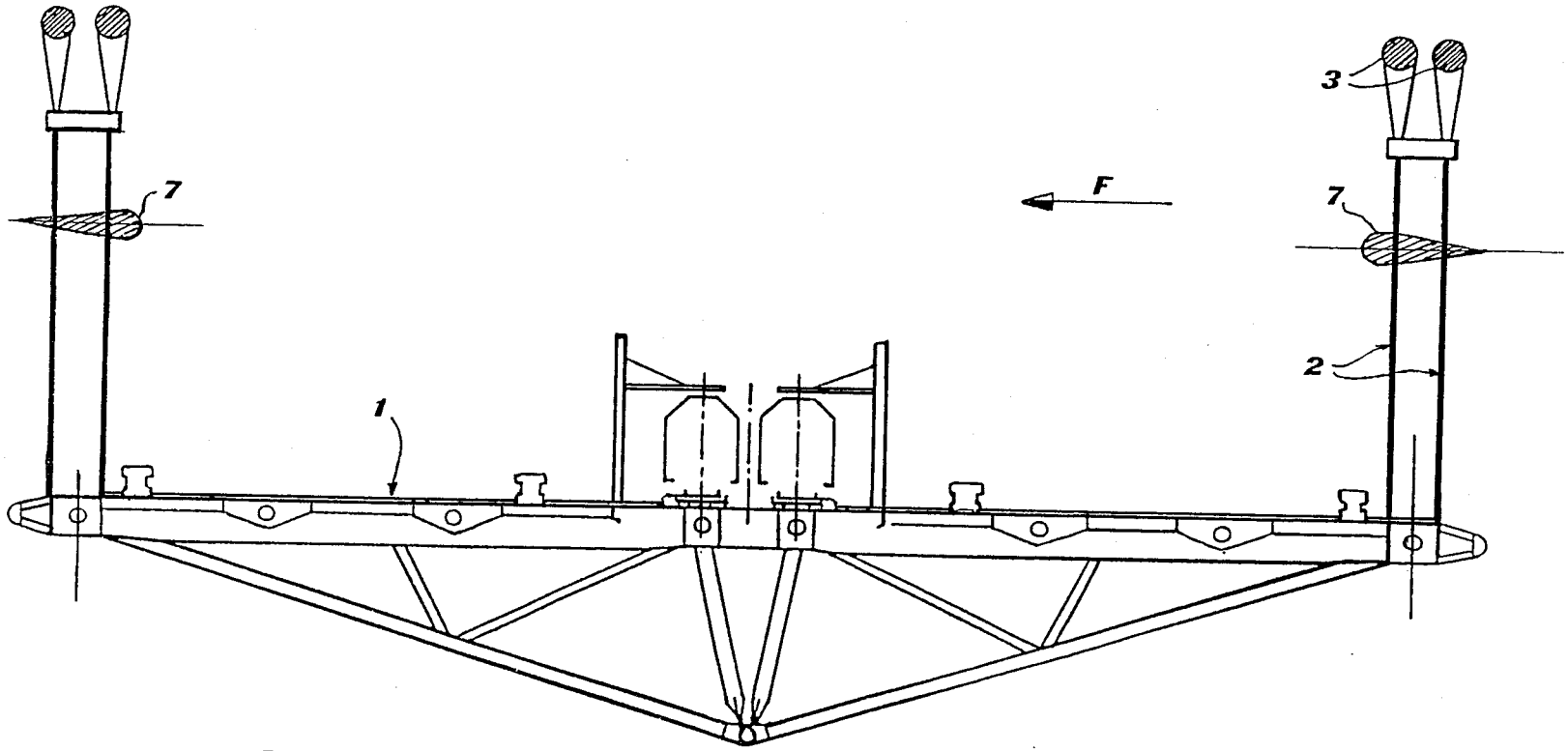
FIG. 3 is a diagrammatic cross section view, also along the line II—II of FIG. 1, of a second embodiment of the bridge.

According to the embodiment of FIG. 3, the problem of damping the flutter phenomena is solved by providing wing control surfaces 7 which are instead fixed onto the suspension stays 2, at a height above the uppermost level reached by the traffic or by the fixed structure associated to the roadway 1 being, in this case, the pylons supporting the railway overhead electric line. This arrangement is meant to prevent the air stream, which hits said wing surfaces, from being in any way influenced by said fixed structure or by the traffic crossing the bridge.

The wing surfaces 7 have in turn a symmetrical profile and are positioned with their plane of symmetry on a horizontal line and firmly fixed, preferably, in this position. In specific environmental conditions, it may however be possible to provide for the wing surfaces to be hinged and to be adjustable in position, even automatically, so as to obtain a greater damping efficiency from said surfaces.

According to a further characteristic, both leading edges of the wing profiles of the surfaces 7 face towards the centre of the bridge, so that, in respect of the wind direction indicated by the arrow F and tranversal to the bridge, the working wing surface is essentially the one downstream.

The wing surfaces 7 are preferably provided in correspondence of a portion of the bridge length, for instance that portion which—according to the positioning of the bridge in respect of the surrounding orographic situation—is most affected by the action of the wind. In the case of the arrangement of FIG. 2, the wing surfaces are instead preferably provided along the whole bridge length.

It is anyhow understood that the invention is not limited to the heretofore described and diagrammatically illustrated embodiments, and that there may be other embodiments, differing from the same, all within easy reach of an expert in the field, but all obviously falling within the scope of the above inventive idea. In particular, it should be pointed out that the invention can also be applied in combination with the known techniques: as mentioned, above all the use of "transparent" roadways undoubtedly improves the behaviour of the bridge in strong wind conditions.

I claim:

1. Suspension bridge structure comprising a suspension bridge having a horizontally oriented, substantially flat main structure that terminates in lateral edges, said suspension bridge having a flutter speed below the top speed of the wind expected in the bridge area, and at least one wing for generating a vertically oriented force when exposed to a side wind moving substantially parallel to said flat main structure, the flutter speed proper to said wing being considerably higher that the flutter speed proper to the bridge structure, and said bridge structure and said wing being rigidly interconnected in order to shift the flutter speed of the suspension bridge structure at least above the top speed of the wind expected in the bridge area.

2. Suspension bridge structure as is claim 1, wherein said wing has a symmetrical profile, said wing beign fixed under one of said lateral edges of the flat main structure of the bridge, with its plane of symmetry inclined with respect to the horizontal plane.

3. Suspension bridge structure as in claim 2, wherein said wing has a leading edge, and the leading edge of said wing is adjacent to one of said lateral edges of the bridge.

4. Suspension bridge structure as in claim 2, wherein said suspension bridge has a roadway structure and further includes a wind deviation means having a non-lifting aerodynamic control surface for deviating the wind stream, said wind deviation means being positioned laterally along an edge of the bridge and above the surface of the bridge structure.

5. Suspension bridge structure as in claim 4, wherein said wind deviation means includes a grating having a parabolic shape with its convex side facing towards one of said edges of the bridge.

6. Suspension bridge structure as in claim 1, wherein said suspension bridge has a roadway structure for conducting vehicles said wing has a symmetrical profile, said wing being anchored to the suspension bridge at a height above the maximum height of the roadway structure, as well as of any vehicles conducted thereon.

7. Suspension bridge structure as in claim 6, wherein the suspension bridge structure includes two suspension structures, each of which is fixed along one side of said bridge, and further including two wings, each of which has a leading edge and each of which is mounted on one of the two suspension structures fixed to the birdge sides, and each of which is positioned with its plane of symmetry horizontally oriented and with its leading edge facing towards the longitudinal central axis of the bridge itself.

8. Suspension bridge structure as in claim 1, wherein the wing is stably and rigidly fixed to the bridge structure, so as to form a structural component with the bridge as a whole that dynamically responds in a unitary manner therewith to stresses caused by the wind.

9. Suspension bridge structure as in claim 8, wherein the inclination of the plane of symmetry of said wings is adjustable with respect to the horizontal plane.

10. Suspension bridge structure as in claim 1, wherein said wing extends along a selected portion of the bridge length.

11. Suspension bridge structure as in claim 1, wherein said wing is positioned along the whole bridge length.

12. Suspension bridge structure as in claim 1, having a roadway incorporating transparent surfaces essentially in the form of gratings.

* * * * *